United States Patent [19]

Andersson

[11] 4,280,290

[45] Jul. 28, 1981

[54] GARMENT PRESSING MACHINE

[76] Inventor: Åke Andersson, Skolvägen 15, Aplared, Sweden, 510 53

[21] Appl. No.: 107,875

[22] Filed: Dec. 28, 1979

[30] Foreign Application Priority Data

Jan. 9, 1979 [SE] Sweden ..... 7900171

[51] Int. Cl.[3] ..... D06F 71/08

[52] U.S. Cl. ..... 38/31; 38/33; 38/35

[58] Field of Search ..... 38/30, 31, 32, 33, 34, 38/35

[56] References Cited

U.S. PATENT DOCUMENTS

| | | | |
|---|---|---|---|
| 1,967,083 | 7/1934 | Emery | 38/31 X |
| 1,967,084 | 7/1934 | Emery | 38/30 X |
| 2,728,152 | 12/1955 | Campbell | 38/35 |
| 3,490,159 | 1/1970 | Radford et al. | 38/35 |
| 3,496,660 | 2/1970 | Frisby | 38/35 |
| 3,500,567 | 3/1970 | Tucker et al. | 38/35 |

*Primary Examiner*—Louis Rimrodt
*Attorney, Agent, or Firm*—Holman & Stern

[57] ABSTRACT

The invention refers to a garment and like pressing machine comprising a stationary buck mounted on a frame and a complementary head moveably supported relative to the buck. The head is after the pressing operation initially elevated upwardly from the buck and then rearwardly away from the buck. The head is mounted at one end of a double-armed lever, which is pivotally mounted at the upper end of a column. The column is at its lower end pivotally mounted to the frame and is actuated by a power-operated jack. A second power-operated jack acts on one end of a second double-armed lever having the same pivot axle as the column. The opposite end of said second lever is connected to the first lever through a link. The second jack can by acting on the second lever move the head vertically downwardly into pressing contact with the buck and elevate it therefrom resp.

1 Claim, 4 Drawing Figures

GARMENT PRESSING MACHINE

BACKGROUND OF THE INVENTION

The present invention refers to a garment and like pressing machine of the kind comprising a frame, a stationary buck supported on the frame and a pressing head moveably supported relative to the buck and means being arranged for moving the head forwardly in vertical registry with the buck and rearwardly away therefrom and further means being arranged for moving the head vertically into and out of pressing contact with the buck.

At many previously known garment pressing machines the moveable head is pivoted upwards about a pivot axle and remains in this raised position above the stationary buck. The head is in this position located about at the level of the face of the person operating the pressing machine and since it in many cases has a temperature of between 100°–200° C. there is a great risk for burns and the strong heat radiation is a serious inconvenience.

For this reason pressing machines have been constructed (e.g. the U.S. Pat. No. 1,967,083 and the German Auslegeschrift 1,256,615), where the head by means of a linkage system is moved backwards after it has been raised. The above mentioned drawbacks are then avoided. These linkage systems however are complicated and the reliability is not good. Besides it is difficult to achieve a sufficient pressing pressure of the head with this kind of power transmission.

In the German Offenlegungsschrift 2,263,786, the U.S. Pat. No. 3,490,159 and the British Pat. No. 1,364,938 are also shown pressing machines, where the arm with the head is pivoted backwards after the head has been raised from the buck. For all these previously known pressing machines the arm with the head makes a curve-shaped movement backwards-downwards and forwards-upwards resp., which means a relatively slow movement. Besides the moveable head will during a certain period of the pivoting movement be directed obliquely forwards, so that the heat radiation from the head can hit the operator. The pressing machines shown in these earlier publications are also relatively complicated.

SUMMARY OF THE INVENTION

The object of the invention is to provide a pressing machine, where the moveable head is initially elevated upwardly out of pressing contact with the buck and thereafter is moved rearwardly therefrom, said pressing machine being simpler, more rugged and more reliable than previously known pressing machines. The mechanism for the power transmission to the moveable head shall ensure that at a sufficient pressing pressure is achieved. The arm with the moveable head shall further make a substantially linear movement rearwardly away from and forwards towards the stationary buck. A pressing machine working more rapidly is thereby achieved at the same time as the heat radiation from the moveable head during the entire movement is directed downwardly, i.e. is during no moment directed forwards towards the operator.

These objects have according to the invention been fulfilled by a pressing machine of the kind stated above, in which the head is mounted at one end of a double-armed lever, which is pivoted to the upper end of a column, which at its lower end is pivoted to the frame and which is actuated by a first power-operated jack.

DESCRIPTION OF AN EMBODIMENT

Figure 1:
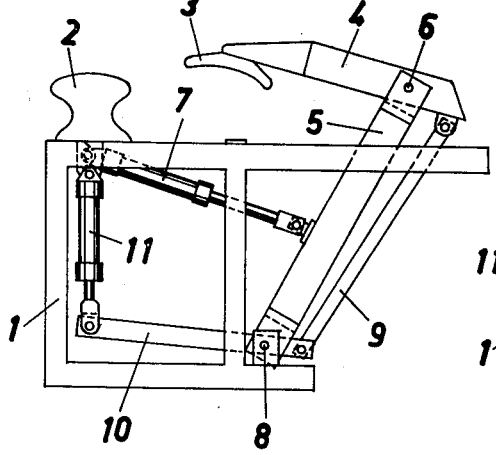
FIGS. 1–3 are side views of the pressing machine according to the invention shown in three different positions.

The pressing machine comprises a frame 1 supporting a stationary buck 2. A moveable head 3 is arranged at one end of a first double-armed lever 4, which is substantially horizontally arranged and which is pivotally mounted about an axle 6 at the upper end of a column 5. The column 5 is with its lower end pivotally mounted to the frame 1. A first power-operated jack, e.g. a hydraulic cylinder 7, acts upon the column 5 to pivot this about its lower pivot axle 8. The hydraulic cylinder 7 is mounted in the frame 1 just below the buck 2.

Figure 4:
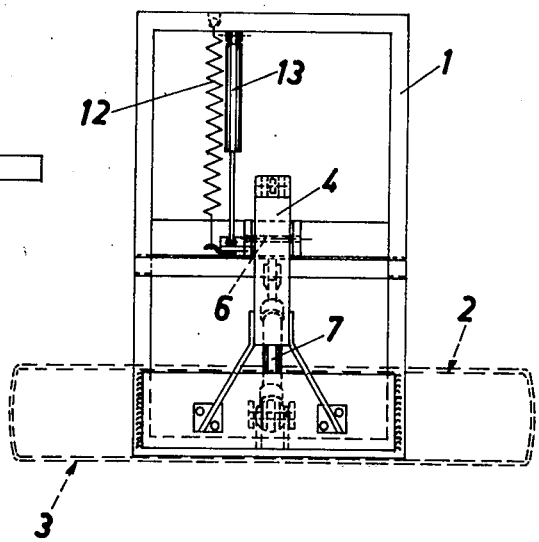
FIG. 4 shows the pressing machine from above.

A link 9 is pivotally arranged at the end of the first lever 4 remote from the buck 2, said link 9 with its opposite lower end being pivotally connected to one arm of a second substantially horizontally arranged double-armed lever 10. The lever 10 is pivotally mounted in the frame 1 about the same pivot axle 8 as the column 5. A second power-operated jack, e.g. a hydraulic cylinder 11, acts upon the other arm of the lever 10, said hydraulic cylinder being connected to the frame just opposite the stationary buck 2 and the first hydraulic cylinder 7. According to the embodiment shown the second hydraulic cylinder 7 is single-acting, and thus a pull back spring 12 (FIG. 4) is arranged between the column 5 and the rear portion of the frame 1 remote from the stationary buck 2 in order to pivot the column 5 back to its position in vertical alignment over the buck 2. A damper 13 is arranged in parallel with the spring 12.

The pressing machine operates in the following manner. In the position shown in FIG. 1 the moveable head 3 is out of vertical registry with the stationary buck, i.e. in inactive position. The garment can now be dressed on the buck. By action of the pull back spring 12, which is damped by the damper 13, the column 5 is pivoted forwardly and upwards to a vertical position, at which the moveable head 3 at the end of the first lever 4 will be located vertically aligned over and out of contact with the buck 2. (FIG. 2). The second hydraulic cylinder 11 then acts upon the second lever 10 to pivot it about the axle 8 and thus elevating the link 9. The first lever 4 is then pivoted about its axle 6 and moves the head 3 against the buck 2. The uncomplicated power transmission from the hydraulic cylinder 11 to the moveable head 3 through the levers 10 and 4 and the link 9 ensures that a sufficient pressing pressure is obtained.

Figure 2:
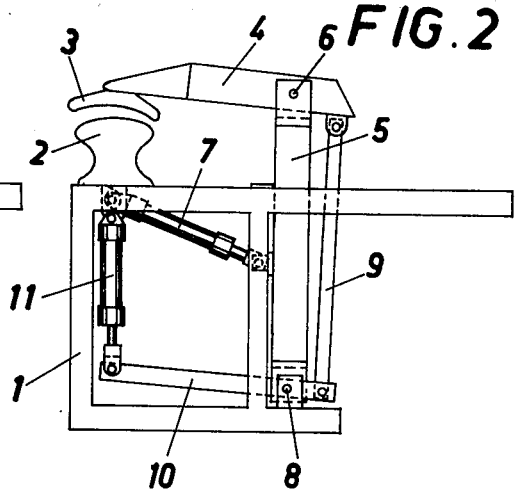
Figure 3:
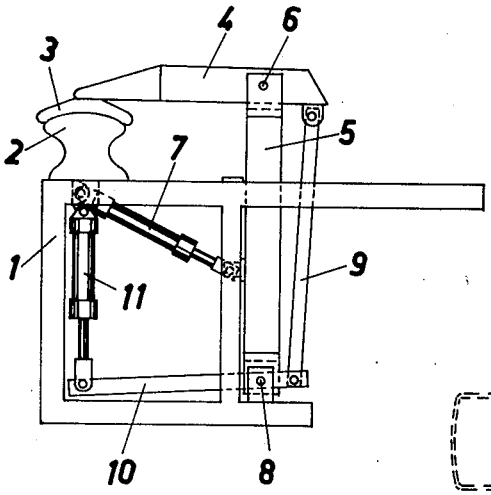

After the garment has been pressed the head 3 is elevated from the buck 2 by retracting the piston of the hydraulic cylinder 11 to its position above the buck 2 (FIG. 2), after which the column 5 by means of the hydraulic cylinder 9 is pivoted rearwardly at which the lever 4 with the head 3 is moved out of vertical registry with the buck 2 (FIG. 1). The hot head 3 will then be located so far away from the operator that there hardly is any risk for burns and the unpleasant heat radiation is hardly perceptible.

The first lever 4 with the head 3 makes a substantially linear movement rearwardly away from and forwardly over the stationary buck 2. This means that the pressing machine can operate very quickly. Besides that the heat radiation from the head 3 is during the whole movement directed downwards, i.e. is during no moment directed forwards towards the operator.

The invention is of course not limited to the embodiment described and shown but can be varied within the scope of the claim. For example the first hydraulic cylinder 7 can be connected to the frame 1 at the rear end thereof remote from the stationary buck 2 instead of just below the buck as is shown in the drawings.

What I claim is:

1. A garment and like pressing machine of the kind comprising a frame, a stationary buck supported on the frame and a pressing head moveably supported relative to the buck, means being arranged for moving the head forwardly in vertical registry over the buck and rearwardly away therefrom and further means being arranged for moving the head vertically into and out of pressing contact with the buck, said head being mounted at one end of a double-armed lever, which is pivoted to the upper end of a column, which at its lower end is pivoted to the frame and which is actuated by a first power-operated jack, at the opposite end of said lever the upper end of a link being pivoted, the lower end of which being pivoted to one end of a second double-armed lever, which is pivoted to the frame about the same axle as the column, and a second power-operated jack being arranged for acting upon the opposite end of the second lever remote from the link for applying pressing pressure to the head.

* * * * *